US005290179A

United States Patent [19]

Weingartner

[11] Patent Number: 5,290,179

[45] Date of Patent: Mar. 1, 1994

[54] JACK PLUG

[75] Inventor: Bernhard Weingartner, Feldkirch, Austria

[73] Assignee: Neutrik Aktiengesellschaft, Schaan, Liechtenstein

[21] Appl. No.: 930,850

[22] Filed: Aug. 14, 1992

[30] Foreign Application Priority Data

Aug. 23, 1991 [DE] Fed. Rep. of Germany ..... 4128034
Aug. 24, 1991 [DE] Fed. Rep. of Germany ..... 4128098

[51] Int. Cl.[5] ..... H01R 13/00
[52] U.S. Cl. ..... 439/669
[58] Field of Search ..... 439/668, 669

[56] References Cited

U.S. PATENT DOCUMENTS

| | | | |
|---|---|---|---|
| 1,552,227 | 10/1925 | Pacent | 439/669 |
| 1,642,064 | 9/1927 | Engstrom | 439/669 |
| 4,196,958 | 4/1980 | Takahashi | 439/669 |
| 4,335,930 | 6/1982 | Feldman | 439/669 |

*Primary Examiner*—Joseph H. McGlynn

*Attorney, Agent, or Firm*—Lloyd McAulay; Julius Fisher; J. Harold Nisson

[57] ABSTRACT

A jack plug has a contact bulb provided at its free end having a contact shaft serving for the electrical connection of an electrical conductor. The contact shaft penetrates the center of a tubular shaft of the plug serving as an external contact. An insulating material is provided between the contact shaft of the contact bulb and the tubular shaft. The shaft serving as external contact continues into a portion at the side remote from the contact bulb. The portion extends beyond the inner end of the insulating tube and has a greater diameter than the shaft. This portion is received by a gripping sleeve. The portion has axially parallel notches proceeding from its free front side. These front sides of the portion contact corresponding inner surfaces of the gripping sleeve which is screwed on by means of an internal thread. The notches extend substantially along the entire axial length of the portion. The internal thread of the gripping sleeve is provided at the side facing the contact bulb. The counterthread is arranged in the region of a step between the tubular shaft and the portion.

20 Claims, 1 Drawing Sheet

JACK PLUG

BACKGROUND OF THE INVENTION a) Field of the Invention

The present invention is directed to a jack plug and, more particularly, a jack plug with a contact bulb provided at its free end having a contact shaft serving for the electrical connection of an electrical conductor.

b) Background Art

A great number of jack plugs of the most varied constructions are known. These numerous constructional forms are relatively costly and complicated (U.S. Pat. No. 3,656,089, U.S. Pat. No. 4,275,947, U.S. Pat. No. 4,335,930, U.S. Pat. No. 4,647,135, RPS 561 322).

A jack plug is known from German Offenlegungsschrift 15 38 34 172 in which a tubular shaft serves as external contact and which has a portion having a greater diameter than this shaft which is constructed as a single piece. The portion, however, carries an external thread adjacent to the aforementioned shaft. A gripping sleeve is screwed onto the external thread and covers the aforementioned portion. No functional cooperation between the portion and the gripping sleeve is provided or ascertainable. The portion is indented at diametrically opposite sides to provide pull relief for the cable and to make electrical contact between the external contact and the cable sheath. The indentations press on the inserted cable and its sheath, which is exposed in this location, so as to hold and clamp the cable.

Comparable constructions are shown in U.S. Pat. No. 4,196,958 and U.S. Pat. No. 4,275,947. The free end of the portion has short notches extending over only part of the axial length of the portion. The region having the notches is further provided with an external thread. A gripping sleeve whose axial length does not exceed approximately to the axial length of the portion carries an internal thread at its inner side remote from the contact bulb and can be screwed onto the external thread at the free, slotted end of the aforementioned portion. The free edges of the portion are tapered or beveled conically. When the gripping sleeve is screwed on, the edge of the cable insertion bore hole of the gripping sleeve contacts the beveled edge As a result of the cooperation of these parts, the short tabs formed by the notches are pressed together somewhat when the gripping sleeve is tightened and screwed on and thus grasp the cable running through the portion in a clamping manner.

In the construction according to U.S. Pat. No. 4,196,958, the contact shaft which communicates with the contact bulb so as to be electrically conducting is so long that it projects beyond the insulating tube and into the interior of the plug, i.e., into the portion which extends beyond the inner end of the insulating tube and has a diameter which is greater than that of the shaft serving as external contact, although this portion is constructed so as to form one piece with the latter. The portion of the contact pin projecting beyond the insulating tube has a recess for receiving the free inner end of the conductor. The conductor end is either soldered or crimped. Cut out portions through which a tool can be inserted for connecting the aforementioned conductor end with the contact shaft are provided in the portion. In one instance, crimping tools are inserted through the aforementioned cut out portions; in another case, the solder and soldering iron are inserted through these openings.

These previously known constructions have disadvantages: the gripping sleeve, to the extent that it is constructed in one piece, is only supported on one side in this case and extends over the aforementioned portion in a cantilevering manner. If the inside of the gripping sleeve is to contact the outside of the portion for the purpose of stabilizing the construction as a whole, the gripping sleeve must be constructed in two parts. Since the relatively short notches and the external thread on the portion overlap, the tabs formed by the notches can only exert their pincer function to a limited extent because the more the tabs are pressed in radially, the weaker the engagement of the coupled threads.

OBJECTS AND SUMMARY OF THE INVENTION

The present invention aims at constructing a jack plug of the type presently considered in such a way that the gripping sleeve can not only be connected with the rest of the plug parts in a stable and robust manner, but the tabs formed by the notches also exert their pincer function regardless of the extent to which the gripping sleeve is screwed onto the thread.

Another problem in this context consists in the considerable cost of producing the electrically conducting connection between the plug and conductor, and the present invention also is direct to designing a jack plug of the aforementioned type in such a ay that the cost of producing the connector is simplified without impairing the reliability and durability of this electrical connection. On the contrary, this connection producing electrical contact is to be improved over the known steps in spite of the simplified assembly.

For a better understanding of the present invention, reference is made to the following description and accompanying drawings while the scope of the invention will be pointed out in the appended claims.

DESCRIPTION OF THE PREFERRED EMBODIMENTS

Figure 1:
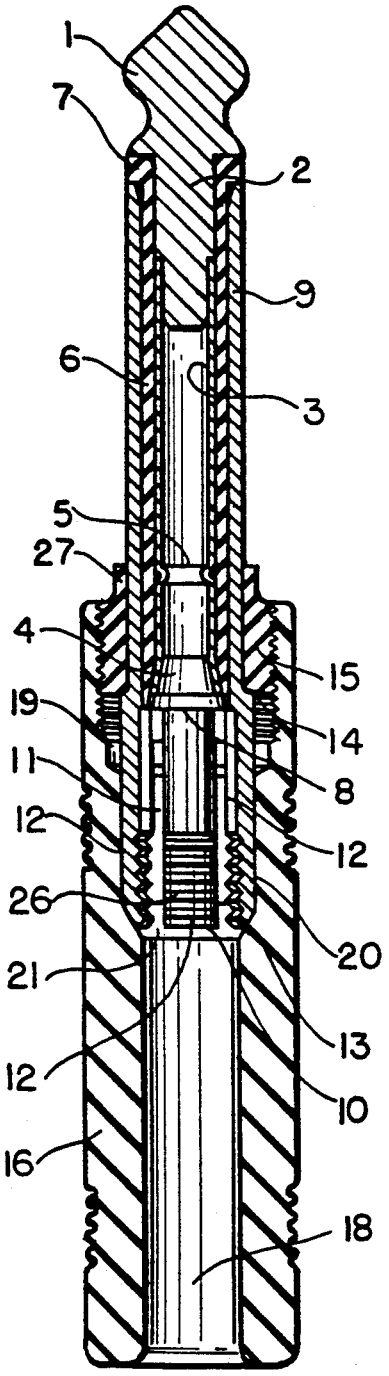
FIG. 1 shows a longitudinal section through the jack plug.

In accordance with the invention, this object is met in a jack plug of the type having a contact bulb provided at its free end having a contact shaft serving for the electrical connection of an electrical conductor. The contact shaft penetrates the center of a tubular shaft of the plug serving as an external contact. An insulating material is provided between the contact shaft of the contact bulb and tubular shaft. The shaft serving as external contact continues into a portion at the side remote from the contact bulb. The portion extends beyond the inner end of the insulating tube and has a greater diameter than the shaft. This portion is received by a gripping sleeve. The improvement comprises that the portion has axially parallel notches proceeding from its free front side. These front sides of the portion contact corresponding inner surfaces of the gripping sleeve which is screwed on by means of an internal thread. The notches extend substantially along the entire axial length of the portion. The internal thread of the gripping sleeve is provided at the side facing the contact bulb. The counterthread is arranged in the region of a step between the tubular shaft and the portion.

The second object is achieved according to the invention by a jack plug of the type having a contact bulb provided at the free end having a contact shaft serving for the electrical connection of an electrical conductor. The conductor shaft penetrates the center of a tubular shaft of the plug serving as an external contact. An insulating tube of electrically insulating material is provided between the contact shaft of the contact bulb and the tubular shaft. The shaft serving as external contact continues into a portion at the side remote from the contact bulk. The portion extends beyond the inner end of the insulating tube and has a greater diameter than the shaft. This portion is received by a sleeve. The improvement comprises that the inner receiving bore hole of the contact shaft has a cross-sectional narrowing for a conductor. The conductor, insertable in the receiving bore hole, is held in a clamping and contact-making manner.

The actively contacting part of the jack plug has a contact bulb 1 with a contact mandrel 2 on which a tubular piece 3 of electrically conducting material is attached as contact shaft. The inner end 4 of tubular, piece 3 is widened in the manner of a funnel. Tubular piece 3 has an inwardly directed, annularly bead 5 in the vicinity of widened end 4 which narrows the cross-sectional diameter of tubular piece 3. It should be noted that tabs can be punched out from the casing of the tubular piece 3 in place of bead 5 and that the tabs are then bent inward somewhat. The contact mandrel 2 and the tubular piece 3 are received by an insulating tube 6 with a collar-like shoulder 7 at the end facing the contact bulb 1, The axial length of insulating tube 6 is dimensioned in such a way that it receives the tubular piece 3 and the contact mandrel 2 in their entirety and in such a way that the inner mouth opening of this tubular piece 3 is set back somewhat relative to the inner front side 8 of the insulating tube 6.

The insulating tube 6 is received along its entire length by a tubular shaft 9 serving as external contact and a portion 10 having a somewhat greater diameter than the shaft 9 is connected to this shaft 9 as an integral component part. The portion 10 and shaft 9 merge via an annular step 14. Portion 10 is divided into a plurality of tabs 12 by a plurality of axially parallel notches 11, in this case four. The outer edge 13 of this portion 10 and of the tabs 12 is beveled in a conical manner. The aforementioned axially parallel notches extend along the entire axial length of this portion. These tabs are roughened, preferably outfitted with grooves 26, at the inside at least along a part of their length.

A bushing 15 which carries an external thread is slid onto the shaft 9 and contact contacts the annular step 14, the transition between the shaft 9 and portion 10. Bushing 15 is preferably manufactured from plastic and is produced as a separate part. The side of this bushing 15 facing the contact bulb 1 is preferably constructed as a polygonal step 27 so that a tool, e.g. a small wrench, can be applied to it. This bushing 15 with the external thread can be glued on or simply slid on.

A gripping sleeve 16 with a central bore hole 18 for the passage of a cable 17 has a bore hole 19 at its end facing the contact bulb 1 having an internal thread by which gripping sleeve 16 can be screwed onto the thread of the bushing 15. If the bushing ..15 is only slid onto the shaft 9, bushing 15 can be securely held via screwing on the gripping sleeve 16 manually by means of a tool.

A bore hole portion 20 whose diameter corresponds approximately to the outer diameter of the portion 10 or is somewhat larger than the latter is provided in the gripping sleeve 16 between the bore hole 19 and the central bore hole 18. This bore hole portion 20 passes into the central bore hole 18 via a conical shoulder 21. The length of this bore hole portion 20 is dimensioned in such a way that the conical shoulder 21 contacts the correspondingly constructed edge 13 of the portion 10 or tabs 12 when the gripping sleeve 16 is screwed on. It can be seen from the drawings that the gripping sleeve 16 is considerably longer than the portion 10, preferably approximately three times as long. The diameter of the central bore hole 18 corresponds approximately to the inner diameter of the slotted portion 10. The bore hole with the internal thread facing the contact bulb 1 has a central bore hole 18 with an inner diameter which is greater than the diameter of the central bore hole 18.

The electrical cable 17 connected to the jack plug has a central electrical conductor 22 which is generally constructed as a strand, an inner insulation 23 surround conductor 22, an outer sheath 24 which is formed from a tight wire mesh as a rule, and finally the outer insulation 25.

Figure 2:
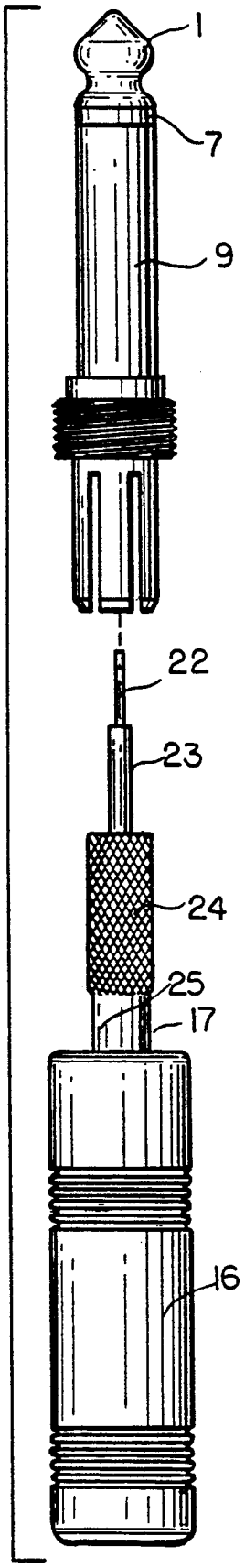
FIG. 2 is an exploded view of the jack plug according to FIG. 1 in the state prepared for assembly, with inserted cable.
Figure 3:
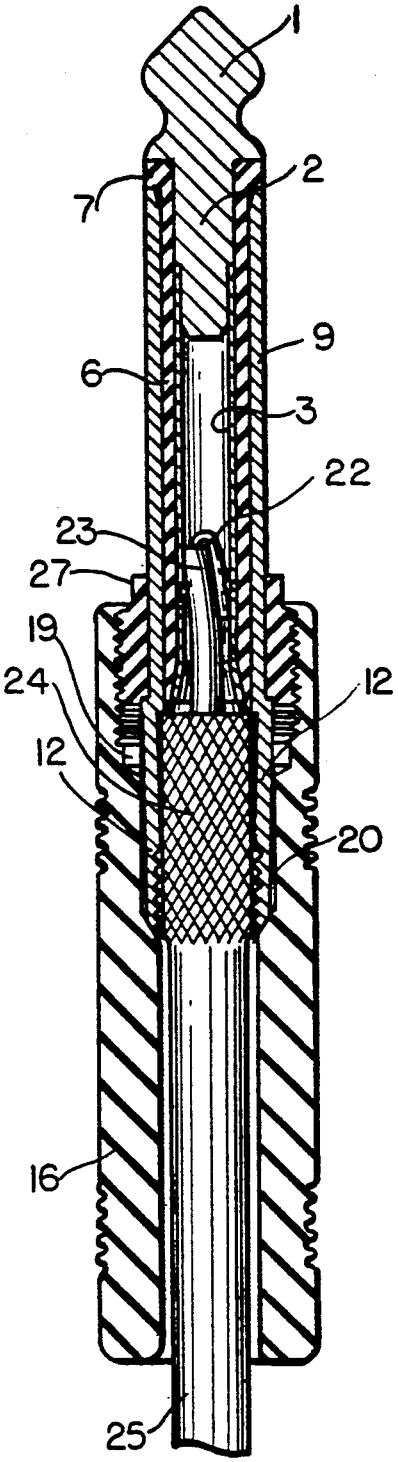
FIG. 3 shows the plug connected with the cable and its conductor according to FIG. 1 after assembly.

The inner diameter of the portion 10 formed by the tabs 12 approximately corresponds to the outer diameter of the cable 17. In preparing the end of the cable for connection to the jack plug described above, the conductor 22 is first freed from the inner insulation and the straight conductor piece is then bent as shown in FIG. 3, and this bent piece of the conductor 22 contacts the inner insulation externally. The sheath 24 which is freed from the outer insulation 25 is stripped back until the inner insulation 23 projects over the drawn back sheath 24 as shown in FIG. 2.

The end of the cable which is prepared in this way is inserted through the gripping sleeve 16 and the cable end with the bent conductor 22 is now inserted into the tubular piece 3. This cable end with the bent conductor 22 is received by the annular bead 5 in a clamping and contact-making manner (FIG. 3). The conductor 22 is not only held by the annular bead 5 so as to be clamped, the conductor piece 22 is accommodated in this tubular piece in an airtight manner and the contact point is protected from environmental influences. The gripping sleeve 16 is then screwed onto the thread of the bushing, and the contact shoulder 21 and beveled edges 13 of the tabs 12 enter into a working connection with one another. Tabs 12 are pressed together in the manner of pincers by the taper of the surfaces or surface portions so that the tabs grasp the cable and its drawn back sheath 23 in a clamping manner. The sheath 24 is accordingly connected with the shaft 9 firmly and in a fixed manner and so as to be electrically conducting in a reliable manner. Moreover, the cable is also secured inside this portion 10 and pulling forces which may act on the cable from the outside can not have an effect on the inner contact point represented by the bead 5. Bead 5 could be replaced by punching out one or more tabs in the casing of tubular piece 3 and bending them inward. Tabs of this kind can serve not only to make contact but also as a securing means.

It should be noted in conclusion that the tubular piece 3, insulating tube 6 and shaft 9 mentioned in the preceding to describe the jack plug according to the invention are relatively small and thin-walled structural component parts and the term "miniature" may correctly describe them. It is mentioned only for the sake of illustration that, e.g., the outer diameter of the shaft 9 is approximately 6.4 mm and the insulating tube 6 has a wall thickness of approximately 0.7 mm. The tubular piece 3 is approximately 23 mm long and has an outer diameter of 3 mm and an inner diameter of approximately 2.5 mm. The component parts mentioned above are to be taken in the described sense.

In the embodiment example shown in the drawing the contact bulb 1 and contact mandrel 2 on the one hand and tubular piece 3 (contact shaft) on the other hand are constructed in two parts. It is within the scope of the invention to manufacture these parts in one piece.

It can be seen from the foregoing description and from the attached drawings that the gripping sleeve 16 is clamped tightly with the contact-making parts between the portion 27 of the bushing 15 and the conical shoulder 21 in the bore hole portion 20 and further that the clamping is not dependent on the extent to which the tabs 12 are bent in, and further that these tabs 12 are bendable over a great distance with little force because of their considerable length and their arrangement inside the construction.

The actual contact-making parts which were described in detail in the preceding can also be modified while retaining the features substantial to the invention. For example, a solid pin with a solder bushing at its free end can be provided instead of the tubular piece 3 and this solder bushing can be situated inside the portion 10. Crimping sleeves can also be provided instead of solder bushings as in the previously known constructions mentioned in the introductory part of the specification.

While the foregoing description and drawings represent the preferred embodiments of the present invention, it will be obvious to those skilled in the art that various changes and modifications may be made therein without departing from the true spirit and scope of the present invention.

What is claimed is:

1. In a jack plug having a contact bulb, the contact bulb being supported by a shaft having a cylindrical external contact, a cylindrical insulating member being positioned within the external contact and coaxial to the external contact and a cylindrical internal conductive member positioned within the insulating member and electrically connected to the bulb, the external contact having a first diameter, a cylindrical portion connected to the external contact having a diameter larger than the first diameter, and a gripping sleeve for receiving the cylindrical portion, the improvement comprising:

a shoulder formed at the connection of said external contact and said cylindrical portion;

first threads provided on said cylindrical portion adjacent to said shoulder;

second threads positioned within said gripping sleeve for engaging said first threads when said gripping sleeve receives said cylindrical portion, and tabs being formed in said cylindrical portion by axially parallel notches extending substantially along the axial length of said cylindrical portion, said tabs contacting an inner surface of said gripping sleeve and being compressed when said second threads engage said first threads.

2. The improved jack plug of claim 1 wherein said internal conducting member has first and second ends and a third axial length and, wherein said insulating member has third and fourth ends, said insulating member having an axial length that is longer than said third axial length and said insulating member being positioned so that said third and fourth ends extend past said first and second ends in the axial direction.

3. The improved jack plug of claim 1 which further comprises a bushing, said bushing sliding over said shaft and having said second threads thereon.

4. The improved jack plug of claim 3 wherein said bushing has a polygonal step for receiving a tool for tightening said bushing within said gripping sleeve.

5. The improved jack plug of claim 1 wherein said gripping sleeve has a first axial length and said cylindrical portion has a second axial length, said first axial length being proportional to said second axial length.

6. The improved jack plug of claim 5 wherein said first axial length and said second axial length are defined by the proportion 3:1.

7. The improved jack plug of claim 1 wherein said gripping sleeve has a first and second inner diameter and said cylindrical portion has a third inner diameter, said first inner diameter measuring across said second threads and said second diameter being smaller than said first inner diameter and substantially equal to said second inner diameter, wherein said first inner diameter receives said portion.

8. The improved jack plug of claim 7 wherein said third inner diameter is formed by said inner surface, said second inner diameter and said third inner diameter being aligned to form a through hole.

9. The improved jack plug of claim 1 wherein said insulating member projects within said cylindrical portion.

10. The improved jack plug of claim 9 wherein said gripping sleeve has a bore hole defined by said inner surface, said inner surface being a conical shoulder.

11. The improved jack plug of claim 10 which further comprises a bushing, said bushing sliding over said shaft and having said second threads thereon.

12. The improved jack plug of claim 1 wherein said tabs have an inner side, said inner side being roughened.

13. The improved jack plug of claim 12 wherein said inner side has grooves thereon.

14. In a jack plug having a contact bulb, the contact bulb being supported by a shaft having a cylindrical external contact, a cylindrical insulating member being positioned within the external contact and coaxial to the external contact and a cylindrical internal conducting member positioned within the insulating member and electrically connected to the bulb, the external contact having a first diameter, a cylindrical portion connected to said external contact having a diameter larger than the first diameter, and a gripping sleeve for receiving the cylindrical portion, the improvement comprising:

electrically conductive and friction operated rigid contact means positioned within said internal conductive member, said rigid contact means receiving and contacting a conductive wire having an insulating casing surrounding a conductor, a portion of the insulating casing being removed to expose a conductor tip, the conductor tip being bent over to contact the insulating casing, said contact means contacting said conductor tip and being activated upon the insertion of the insulating casing and the conductor tip within said contact means.

15. The improved jack plug of claim 14 wherein said contact means is an electrically conductive circumferential bead positioned within said internal conductive member.

16. The improved jack plug of claim 14 wherein said contact means comprises at last one electrically conductive tab protruding within said internal conductive member.

17. The improved jack plug of claim 14, said internal conducting member having first and second ends and a third axial length, said insulating member having third and fourth ends, said insulating member having an axial length that is longer than said third axial length and said insulating member being positioned so that said third and fourth ends extend past said first and second ends in the longitudinal direction.

18. The improved jack plug of claim 14 wherein said internal conductive member is tubular having first and second ends, said first end being electrically connected to said contact bulb and wherein said contact means is located adjacent to said second end.

19. The improved jack plug of claim 18 wherein said second end is funnel-shaped.

20. The improved jack plug of claim 18 wherein said insulating member has a third end positioned adjacent to said contact bulb, said first end of said internal conductive member beng set back from said third end.

* * * * *